United States Patent [19]

Martinsen

[11] Patent Number: 4,848,067

[45] Date of Patent: Jul. 18, 1989

[54] VEST-SADDLE TOY

[75] Inventor: Stewart Martinsen, Murray, Utah

[73] Assignee: Dynatec International, Inc., Salt Lake City, Utah

[21] Appl. No.: 125,656

[22] Filed: Nov. 27, 1987

[51] Int. Cl.[4] ..... B68C 1/02

[52] U.S. Cl. ..... 54/44; 446/28

[58] Field of Search ..... 54/37, 44, 45; 446/28, 446/29

[56] References Cited

U.S. PATENT DOCUMENTS 331,004 11/1885 Reilly et al. ..... 446/28
2,711,296 6/1955 Clark ..... 446/28 X
3,698,608 10/1972 Entwistle ..... 54/44 X
4,608,811 9/1986 Echeverri ..... 54/44

*Primary Examiner*—Robert P. Swiatek
*Attorney, Agent, or Firm*—Lynn G. Foster

[57] ABSTRACT

The present invention discloses a human saddle toy for use by an adult in giving piggyback rides to a child. The human saddle includes a three-point stabilization feature whereby the toy can be used with a substantial decrease in the risk of discomfort and harm to the adult and a reduction in fear and apprehension on the part of the child, with a reduced incidence of injury to the child. The device is adjustable to accommodate both adults and children of various sizes.

10 Claims, 2 Drawing Sheets

VEST-SADDLE TOY

FIELD OF THE INVENTION

This invention relates generally to toys and more specifically to a vest-saddle toy designed for use by an adult or the like by which piggyback rides are given to children.

PRIOR ART

In the past, various types of adult "saddles" have been proposed. Initially, an adult gave piggyback rides without the benefit of any "saddle" device. Children would simply crawl onto the adult's back, wrap their legs around the adult's body and hold on as best they could. The adult would either stand erect or assume a position on his or her hands and knees. In so doing, the child would normally hold on to the adult's hair or shirt collar or grab the face or neck of the adult for stability. As the child was given a ride, the child would typically pull and tug on the adult's hair, neck, face or collar causing discomfort and sometimes minor injury to the adult. Sometimes the child will cover the adult's eyes with his or her hand, obscuring the adult's vision and risking an accident. In addition, often the adult's clothes became soiled, torn or disfigured while giving the child such a ride.

Since there was no support device for the child, the child often slipped down to the lower back portion of the adult. Riding in this position often caused lower back pain for the adult, with the risk of permanent lower back injuries. Also, since there was no support for the child's feet, the child often dug his feet into the adult's side and abdomen, causing further discomfort. In addition, bouncing of the child was more prevalent due to lack of any supporting devices. This bouncing in turn resulted in further likelihood of discomfort and injury to the adult. Furthermore, as the child was riding, a twisting motion, back and forth across the adult's back resulted because the child's position was not stabilized in any manner. This also caused discomfort and injury due to a greater likelihood of a strained or pulled muscle or ligament.

Discomfort was also experienced from the child's perspective. Without stabilization, the child was often very apprehensive about riding. Since there was no adequate support, the child often feared that he or she would fall off while riding. In fact, the child often did fall off and bumping and bruising various parts of the child's body. This in turn not only injured the child, but it also, detracted from the adultchild relationship rather than achieving the opposite, desired result of improving the relationship.

Two prior proposals have been made in an attempt to resolve the problems mentioned above. While solving some of the problems involved, the prior proposals individually and collectively have not adequately resolved others of the problems. These prior proposals have consisted primarily of various types of saddle devices intended to be strapped around the torso of the adult. Nevertheless, one specific deficiency, which remains, is a decided lack of saddle stability.

BRIEF SUMMARY AND OBJECTS OF THE INVENTION

In brief summary, the present invention is generally directed to toys for private use and more specifically to a human saddle device for use by an adult on hands and knees in giving a piggyback ride to a child. The instability problems of the prior art are overcome or substantially alleviated. In its presently preferred form the present human saddle comprises a vest-like garment primarily made from a sturdy cloth material and other suitable material. On the back portion of the vest a padded seat is secured for receiving the buttocks of a child at the central part of the back of the adult in load-transferring, stable relation. Preferably, a releasible strap is placed around the abdominal region of the adult. The stability of the human saddle is markedly enhanced by releasible engagement with the shoulder region of the adult, preferably by use of a loop to surround each shoulder. The human saddle is made more useable by providing for size adjustments to be made in respect to both the adult and the child, without loss of stabilization.

With the foregoing in mind, it is a principal object of the present invention to provide a novel human saddle for use by an adult or the like while on hands and knees to give a piggyback ride to a child.

It is a further significant object of this invention to provide an improved human saddle which gives adequate support for the adult, thus lessening the likelihood of injury to the adult.

It is another important object of this invention to provide a human saddle which has sufficient padding to lessen injuries to adult and child alike.

It is a further dominant object to provide a novel human saddle constructed to provide improved stability which lessens the likelihood of injuries to both child and adult and greatly reduces the fear and apprehension especially of the child but also of the adult that an accident might occur due to instability.

It is another object of the present invention to provide a human saddle toy with adjustment features by which the human saddle will accommodate adults and children of various sizes.

It is a further object of the invention to provide a human saddle toy with a holding strap and adjustable foot stirrups for secure retention of the child.

These and other objects and features of the present invention will be apparent from the detailed description taken with reference to the accompanying drawings.

DETAILED DESCRIPTION OF THE ILLUSTRATED EMBODIMENT

Figure 1:
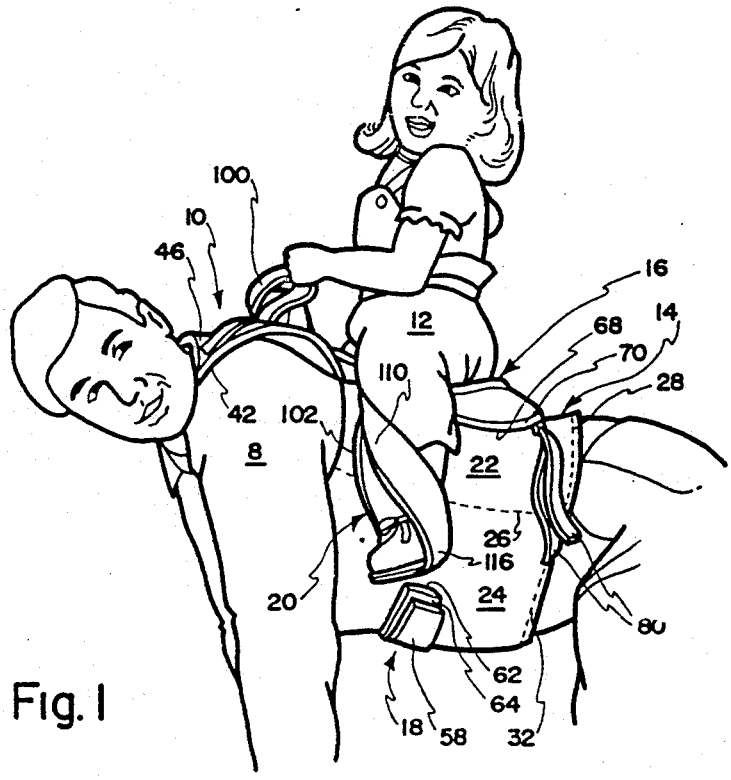
FIG. 1 is a side elevation of a presently preferred human saddle embodiment of the present invention with the saddle being removably secured to an adult on hands and knees and a child sitting on the human saddle in a riding position.
Figure 3:
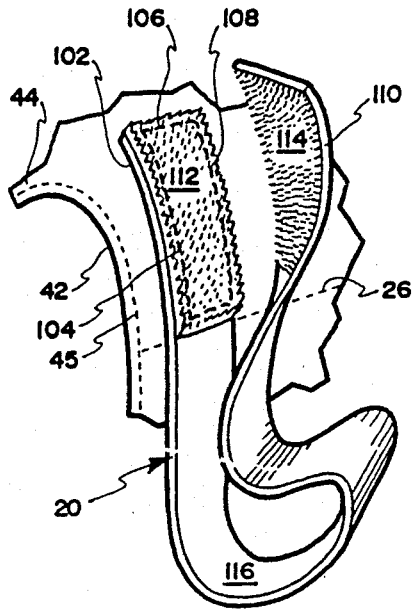
FIG. 3 is a fragmentary enlarged perspective of one of the two adjustable stirrups of the human saddle in FIG. 1 in a released, open position.

Reference is now made to the drawings, wherein like numerals are used to designate like parts throughout. Specific reference is made to FIG. 1, which illustrates a presently preferred human saddle toy embodying the principles of the present invention, generally designated 10. Human saddle 10 is shown in its "as used" position in FIG. 1, with the human saddle 10 correctly placed upon the shoulders and torso of an adult 8, the adult assuming a hands and knees position with a child 12 seated upon the human saddle 10.

Figure 2:
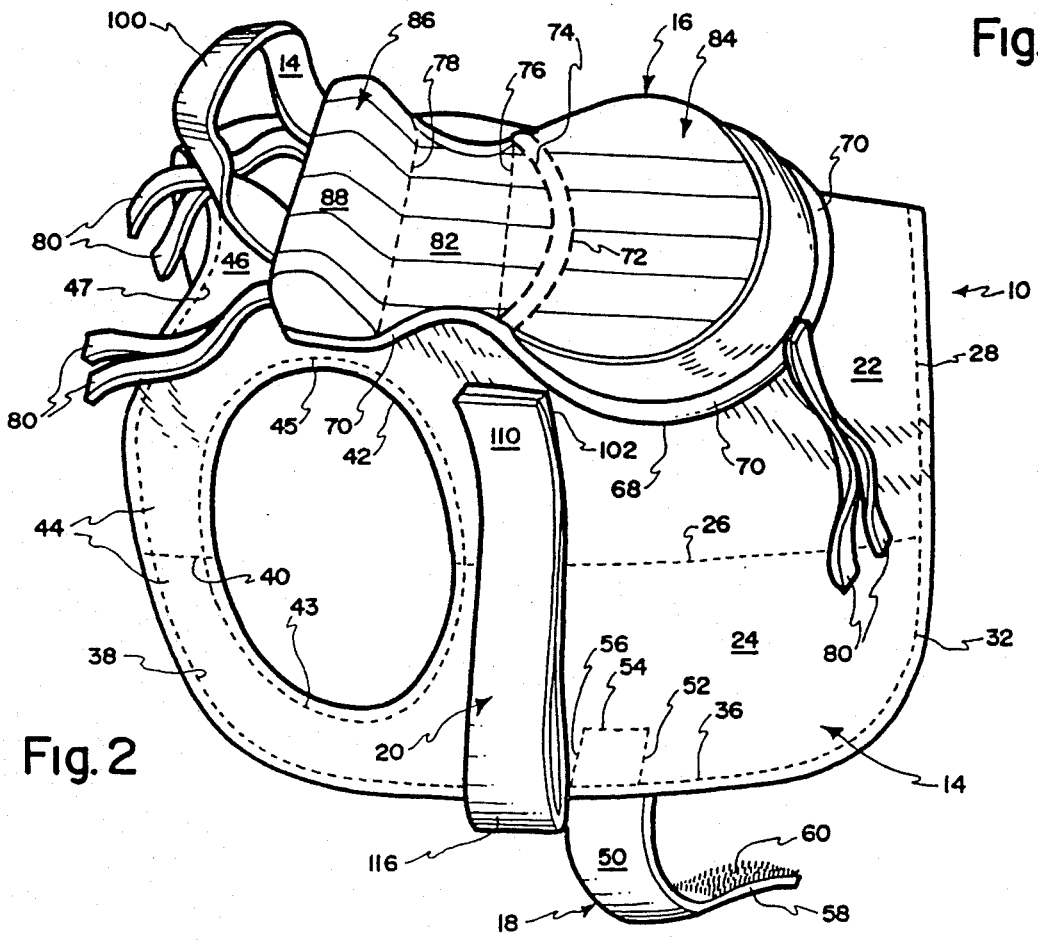
FIG. 2 is an enlarged perspective of the human saddle of FIG. 1 in its open state removed from the adult and without a child rider.
Figure 4:
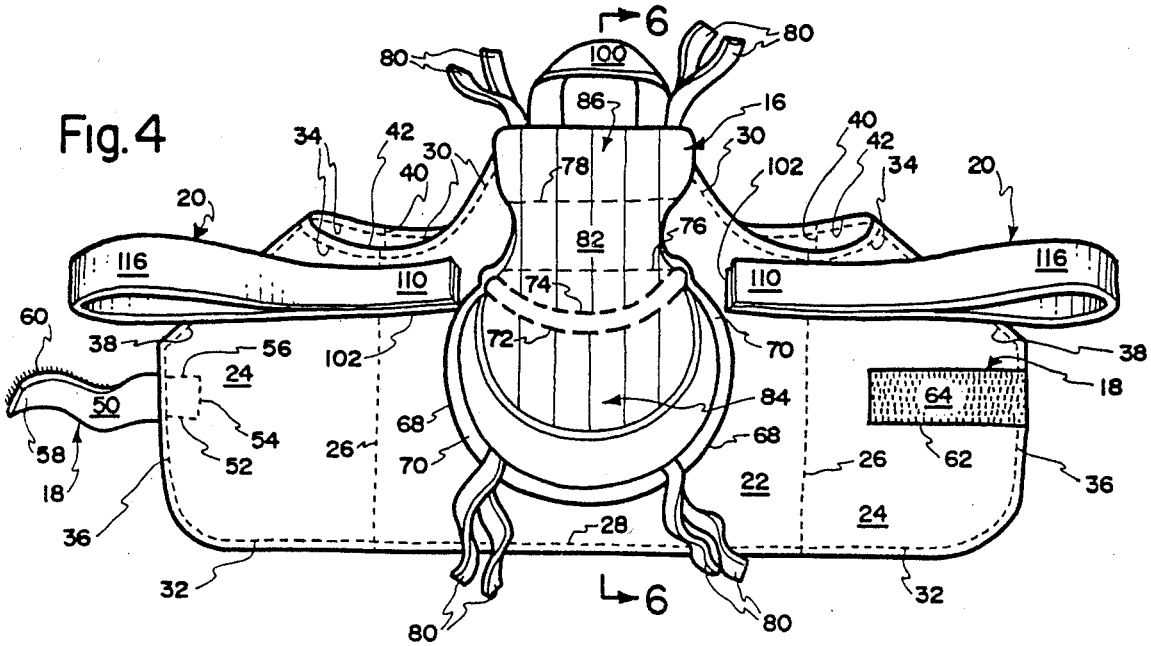
FIG. 4 is a top plan view of the human saddle of FIG. 1 in its opened nonuse state.
Figure 5:
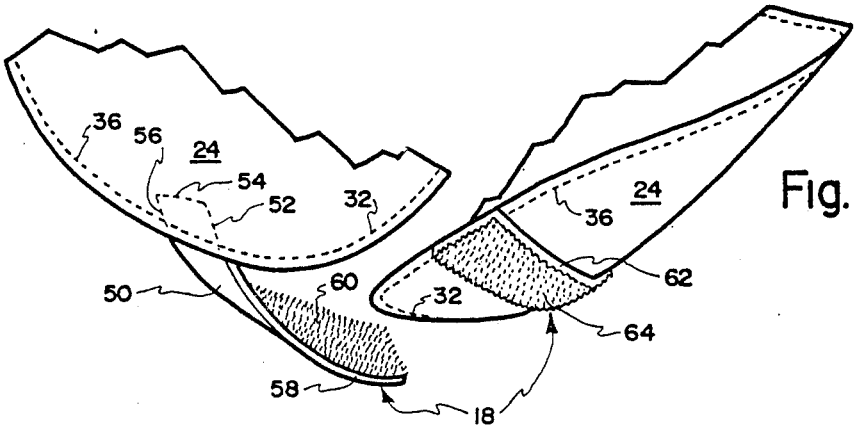
FIG. 5 is a fragmentary enlarged perspective of the abdominal straps with Velcro fasteners of the human saddle of FIG. 1.

As best illustrated in FIGS. 2 and 4, the human saddle 10 comprises a vest-like garment, generally designated 14, seat structure, generally designated 16, which is integrally joined to the back of the garment 14, abdominal strap structure, generally designated 18, and opposed stirrups, each generally designated 20. The two stirrups are identical, although of opposite hand.

The garment is appropriately stitched into a unitary garment by use of several pieces, preferably cut from a bolt or other supply of any suitable cloth, such as cotton denim. The garment 14, as illustrated, comprises a back panel 22 of cloth and opposed opposite hand front panels 24 of cloth. The back panel 22 is stitched along parallel seams 26 to each front panel 24 and preferably each panel is hem stitched or otherwise secured against fraying or the like along edge seams 28, 30, 32, 34, 36, 38, 43, 45, and 47. Otherwise, the panels 22 and 24 are illustrated as being of single ply construction. The back panel 22 is also secured to each front panel along shoulder seam 40.

Thus, the back panel 22 defines approximately one-half of a shoulder opening 42 at each side of the garment 14. The associated front panel 24 of the garment 14 defines the other half of shoulder opening 42. Each opening 42 is defined by a shoulder strap or loop 44, which is sized and shaped to fit contiguously over the shoulder, across the clavicle region and under the arm of the adult 8. While not illustrated, the garment 14 may be provided with sleeves of any desired length.

The back panel 22 is cut so as to define a neck region 46, which is illustrated as being of curvilinear configuration to comfortably fit the neck of the adult 8. Preferably the collar region 46 and the shoulder openings 42 are selected to be large enough so that the vest-like garment 14 may be used by adults of all physical sizes. The torso length of the garment 14 is also selected to be long enough for the same purpose, although dimensions may vary in accordance with intended use. In any event, the adult user 8 will slip the garment 14 over his shoulders and along and around his torso in essentially the same manner as is used in placement of a vest, coat, jacket or the like.

The front panels 24 accordingly come to rest at the chest and abdominal region of the adult user 8. The strap structure 18 is wrapped across the front of the adult to removably fasten one front panel 24 to the other so that the garment 14 is held tightly tot he adult user 8 across the abdominal area. The abdominal strap structure 18 comprises a textile or like strap 50 of suitable predetermined length, which is illustrated as being stitched to the left front panel 24 at the inside thereof at seams 52, 54 and 56. Thus, the strap 50 has an elongated free end 58 when unattached, the inside surface of which is equipped with an array of Velcro fasteners 60.

In alignment with the strap 50 is a belt segment 62 illustrated as being stitched to the right front panel 24. Belt segment 62 presents an elongated array of matching Velcro fasteners 64. Simply stated, once the vest-like garment 14 is properly upon the shoulders of the adult user, the Velcro strap 50 is wrapped around the abdominal area of the adult user 8 with the Velcro fasteners 60 thereof interlocking with the Velcro fasteners 64 of the belt segment 62. Accordingly, the belt structure 18 is adjustable so that it accommodates use of the garment 14 by all types of adults whose size will range from small to large. The abdominal strap structure 18, once assembled into the position illustrated in FIG. 1, will not release inadvertently and, therefore, both the adult user 8 and the child rider 12 will experience not only substantial stability in fact but a sense of reassurance, by reason of an absence of relative movement between the garment 14 and the adult user 8, that an accident will not happen. The three point stability brought into play by the two shoulder loops 44 and the abdominal strap structure 18 essentially prohibit any substantial or material relative displacement between the garment 14 and the adult user 8.

With continued reference to FIGS. 2 and 4, the seat structure, generally designated 16, is illustrated as being permanently sewed onto the back panel 22 of the garment 14 in exposed relation, using a plurality of stitch lines. In the presently preferred illustrated configuration, a reinforced double stitch line is preferably used around the entire periphery or perimeter 68 of the seat structure 16, which perimeter is illustrated as being defined by bias tape or the like 70. The seat structure 16 is also secured to the back panel 22 by a plurality of spaced essentially transverse seams 72, 74, 76 and 78. Attached at the perimeter 68 in super position upon the bias tape 70 are fore and aft streamers 80, which are decorative. These streamers 80 may be formed of any suitable material including, vinyl, leather or cloth.

Figure 6:
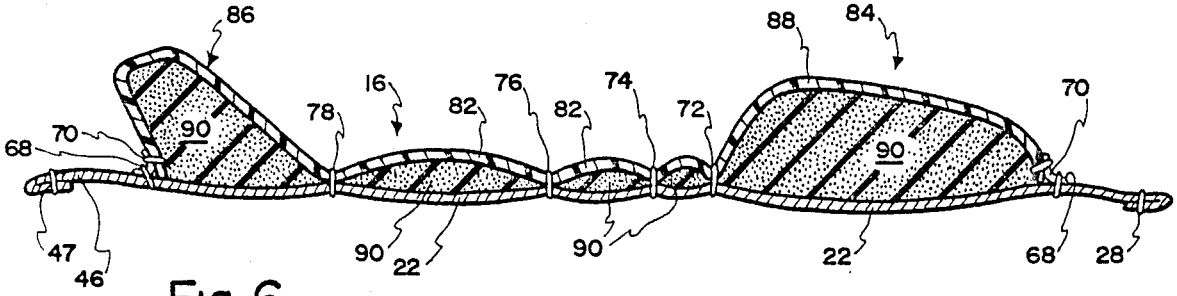
FIG. 6 is a cross-section taken along lines 6—6 of FIG. 4.

The seat portion 16 is contoured, as best illustrated in FIGS. 2 and 6. The exact contour may take any desired form. The contour is intended to provide a low central region 82, for receipt of the buttocks of the child 12, and front and rear elevated regions which tend to block the child 12 from moving substantially in either a forward or rearward direction along the seat structure 16.

The seat portion 16 of the human saddle 10 also comprises an external wear resistant layer or covering 88, formed of the leather, vinyl or the like, vinyl being presently preferred, and interior padding 90 which provides a cushioning effect for both the back of the adult 8 and the buttocks of the child 12 during use. The padding 90 also defines that configuration of the forward and rearward abutment structures 84 and 86. The internal padding 90 may be configurated in any way desired to provide safety and stability in operation of the human saddle 10.

From the forgoing, it should be readily apparent that the seat structure 16 is a very stable and safe device, being permanently attached to the back panel 22 of the vest-like garment 14 so that there is no relative movement between the seat structure 16 and the back panel 22.

Attached to the front seat abutment 86 by stitching or the like is a saddle horn holding strap 100, secured at both ends to the abutment 86 and forming a loop of sufficient size that any child may readily grasp the strap loop with one or both hands to allow the child to maintain balance while the human saddle 10 is in use. Preferably, the strap 100 is formed of a canvas, nylon or like material, which will be very durable over a protracted period of time.

For further rider balance and stability, the human saddle 10 is provided with the heretofore mentioned opposed stirrups 20. Each stirrup 20 is permanently secured at one end 102, as illustrated, to the back panel 22 of the garment 101 along seams 104, 106 and 108. The other end 110 is free, and, therefore, not permanently secured to the garment 14. Velcro fasteners 112 cover a substantial length of the exposed surface of end 102 and mating Velcro fasteners 114 cover a substantial length of one surface of the free end 110. Accordingly, when assembled for use, the central portion 116 of each stirrup forms a loop of adjusted size made by selectively intermeshing the Velcro fasteners 112 and 114. This controls the size of the loop so that it matches the leg length of the child 12. Once the Velcro fasteners 112 and 114 are properly releasibly joined, the end 110 will not inadvertently separate and the loop 116 will remain stable, as initially sized, during use. Preferably, each stirrup 20 is formed of a canvas, nylon or like strap material, which will be highly durable and maintain its structural integrity over a protracted period of time.

The invention may be embodied in other specific forms without department from the spirit or essential characteristics thereof. The present embodiment, is, therefore, to be considered in all respects as illustrative and not restrictive, the scope of the invention being indicated by the appended claims rather than by the foregoing description, and all changes which come within the meaning and range of equivalence of the claims are therefore to be embraced therein.

What is claimed and desired to be secured by United States Letters Patent is:

1. A human saddle used by an adult or the like while on hands and knees to give a generally horizontal piggyback ride to a child comprising:

seat means comprising an underside and an exposed side, the underside being adapted to be contiguous with the central back region of the adult and the exposed side being sized and shaped to receive the buttocks of the child;

means by which the saddle is removably secured to itself around the torso of the adult;

stabilizing means in the form of a unitary jacket-like garment attached to the seat means and removably secured to the shoulder region of the adult to prevent material rotation about a generally horizontal axis of the saddle in respect to the adult's torso due to the child becoming eccentrically disposed upon the adult's back during use.

2. A human saddle according to claim 1 wherein the saddle is of unitary construction and wherein the removably secured means comprise strap means and the stabilizing means include loop means adapted to surround each shoulder of the adult.

3. A human saddle according to claim 2 wherein the strap means comprise releasable fastening means accommodating size adjustment.

4. A human saddle according to claim 3 wherein the releasable fastener means comprise opposed Velcro fasteners.

5. A human saddle according to claim 1 further comprising hand strap means located forwardly adjacent the exposed side of the seat means.

6. A human saddle according to claim 1 further comprising two foot stirrups, one at each side of the seat means.

7. A human saddle according to claim 6 wherein each foot stirrup comprises means by which the length of the stirrup may be adjusted to the size of the child.

8. A human saddle according to claim 7 wherein said adjusted means comprise opposed Velcro fasteners.

9. A human saddle according to claim 1 wherein the seat means comprise means contoured to the buttocks of the child and means adapted to prevent the child from slipping fore or aft.

10. A human saddle used by an adult or the like while on hands and knees to give a generally horizontal piggyback ride to a child comprising:

a unitary jacket-like garment, the back of the jacket-like garment, having seat means attached thereto sized and shaped to receive the buttocks of the child and the front of the jacket-like garment comprising an opening defined by two opposed front panels, with belt means for releasably securing one front panel to the other snugly around the torso of the adult, the jacket-like garment further comprising left and right shoulder loops adapted to snugly surround the shoulders of the adult to stabilize the human saddle during use against material rotation around a general horizontal axis comprising the torso due to any eccentricity in the location of the child upon the seat means.

* * * * *